US011022006B2

(12) United States Patent
Zaher et al.

(10) Patent No.: US 11,022,006 B2
(45) Date of Patent: Jun. 1, 2021

(54) HEAT ENGINE

(71) Applicant: Spirax-Sarco Limited, Cheltenham (GB)

(72) Inventors: Obadah Zaher, Cheltenham (GB); Jeremy Miller, Cheltenham (GB)

(73) Assignee: Spirax-Sarco Limited, Cheltenham (GB)

( * ) Notice: Subject to any disclaimer, the term of this patent is extended or adjusted under 35 U.S.C. 154(b) by 0 days.

(21) Appl. No.: 16/759,581

(22) PCT Filed: Oct. 17, 2018

(86) PCT No.: PCT/EP2018/078376
§ 371 (c)(1),
(2) Date: Apr. 27, 2020

(87) PCT Pub. No.: WO2019/081296
PCT Pub. Date: May 2, 2019

(65) Prior Publication Data

US 2020/0291824 A1 Sep. 17, 2020

(30) Foreign Application Priority Data

Oct. 27, 2017 (GB) ..... 1717675

(51) Int. Cl.
*F01K 13/02* (2006.01)
*F01K 25/08* (2006.01)
(Continued)

(52) U.S. Cl.
CPC ..... *F01K 13/02* (2013.01); *F01K 25/08* (2013.01); *F01K 7/36* (2013.01); *F01K 9/023* (2013.01); *F01K 23/10* (2013.01)

(58) Field of Classification Search
CPC . F01K 13/02; F01K 25/08; F01K 7/36; F01K 9/023; F01K 23/10; F01K 7/14; F01K 17/005; F01K 25/00
See application file for complete search history.

(56) References Cited

U.S. PATENT DOCUMENTS

2008/0121755 A1* 5/2008 Bennett ..... F01K 7/32 244/59
2010/0050628 A1* 3/2010 Staffend ..... F01C 11/002 60/508

(Continued)

FOREIGN PATENT DOCUMENTS

CN 203097963 U 7/2013
CN 203146047 U 8/2013
GB 2457266 A 8/2009

OTHER PUBLICATIONS

Aug. 17, 2018 (GB) Search Report—App. No. GB1717675.1—3 pages.
Jan. 10, 2019 (WO) International Search Report and Written Opinion—App. No. PCT/EP2018/078376—13 pages.

*Primary Examiner* — Hoang M Nguyen
(74) *Attorney, Agent, or Firm* — Banner & Witcoff, Ltd.

(57) ABSTRACT

There is disclosed a heat engine 10 comprising: a heat exchanger 12 to transfer heat from a heat source 100 to a working fluid; a positive displacement expander 16 configured to receive inlet working fluid from the heat exchanger 12 and discharge expanded working fluid as a multiphase fluid so that there is an overall volumetric expansion ratio between the expanded working fluid and the inlet working fluid which is a function of an inlet dryness of the inlet working fluid; a variable expansion valve 14 disposed between the heat exchanger 12 and the expander 16, the valve being configured to introduce a variable pressure drop in the working fluid to vary the inlet dryness; and a con- (Continued)

troller 30 configured to maintain the overall volumetric expansion ratio by controlling the valve 14 to compensate for variable heat transfer to or from the working fluid.

20 Claims, 4 Drawing Sheets

(51) Int. Cl.
*F01K 7/36* (2006.01)
*F01K 9/02* (2006.01)
*F01K 23/10* (2006.01)

(56) References Cited

U.S. PATENT DOCUMENTS

| | | | | |
|---|---|---|---|---|
| 2012/0102954 | A1* | 5/2012 | Ingersoll | F04B 35/008 60/650 |
| 2012/0169049 | A1 | 7/2012 | Oxner et al. | |
| 2014/0026573 | A1* | 1/2014 | Palmer | F01K 17/005 60/649 |
| 2014/0165567 | A1 | 6/2014 | Nagai et al. | |
| 2017/0335724 | A1 | 11/2017 | Johnson et al. | |
| 2018/0120009 | A1* | 5/2018 | Hershgal | F25B 23/006 |

* cited by examiner

HEAT ENGINE

CROSS-REFERENCE TO RELATED APPLICATIONS

The present application is a U.S. National Phase filing of International Application No. PCT/EP2018/078376, filed on Oct. 17, 2018, which claims priority to Great Britain Application No. 1717675.1, filed Oct. 27, 2017, and the present application claims priority to the benefit of the above-identified applications, both of which are incorporated by reference herein in their entireties.

The invention relates to a heat engine comprising a positive displacement expander.

Heat engines are a well-known thermodynamic system for generating power from heat, and typically comprise a primary heat exchanger, an expander, a condenser and a compressor (or pump) which conveys a working fluid in a closed circuit.

Heat engines typically use an expanding turbine to generate motive power as the working fluid expands through the turbine.

Positive displacement expanders have been proposed as an alternative type of expander which may have a higher peak operational efficiency than conventional turbines. A particular type of positive displacement expander is a screw expander. Heat engines including positive displacement expanders have been proposed in which the expander receives a two-phase (i.e. liquid and gas) working fluid and discharges an expanded two-phase working fluid. In such heat engines, optimum expansion efficiency is achieved there is an overall volumetric expansion ratio over the expander which substantially matches a geometrical expansion ratio of the expander.

As is known in the art, the geometrical expansion ratio is related to the relative volumetric proportions of chambers of the positive displacement chamber. In the art, this ratio may be referred to as the Built-In Volume Ratio (or BIVR), and this term is used throughout the present disclosure.

According to a first aspect there is provided a heat engine comprising: a heat exchanger to transfer heat from a heat source to a working fluid; a positive displacement expander configured to receive inlet working fluid from the heat exchanger and discharge expanded working fluid as a multiphase fluid so that there is an overall volumetric expansion ratio between the expanded working fluid and the inlet working fluid which is a function of an inlet dryness of the inlet working fluid; a variable expansion valve disposed between the heat exchanger and the expander, the valve being configured to introduce a variable pressure drop in the working fluid to vary the inlet dryness; and a controller configured to maintain the overall volumetric expansion ratio by controlling the valve to compensate for variable heat transfer to or from the working fluid.

The overall volumetric expansion ratio may be a function of thermodynamic properties of the working fluid, which may in in particular include (but not be limited to) an inlet dryness of the inlet working fluid.

The overall volumetric expansion ratio may be a function of a plurality of thermodynamic properties, for example the inlet dryness of the inlet working fluid, a pressure of inlet working fluid, a pressure of working fluid at exit from the expander and a mass flow rate of the working fluid in the heat engine.

The controller may be configured to maintain the overall volumetric expansion ratio within an optimal range corresponding to a built-in volume ratio of the expander.

The controller may be configured to monitor an operating parameter relating to the overall volumetric expansion ratio. The controller may be configured to control the valve based on the monitored operating parameter.

The operating parameter may be selected from the group consisting of:

- a thermodynamic property of the heat source;
- a flow rate of the heat source;
- a thermodynamic property of a cooling flow to which heat is transferred from the working fluid in the heat engine;
- a flow rate of the cooling flow;
- a thermodynamic property of the working fluid at a monitor location in the heat engine, such as a temperature, pressure or phase composition of the working fluid;
- a mass flow rate of the working fluid;
- a circulation setting of a pump of the heat engine;
- the inlet dryness of the working fluid to the two-phase expander;
- a rotary speed parameter relating to the rotary speed of the expander.

A thermodynamic property of a fluid may be a temperature, a pressure or a phase composition of the fluid.

The controller may be configured to determine a valve setting for the valve by reference to a database or model based on the or each monitored operating parameter.

The controller may comprise the database or model. The controller may comprise a non-transitory machine readable medium comprising the database or model, and instructions which when executed by a processor cause the controller to access the database or model to determine the valve setting (and/or a circulation setting for operating the pump). The controller may comprise a processor. The database or model may be remote from the compressor. The controller may include instructions which when executed by the processor cause the controller to access the remote database or model to determine the valve setting (and/or a circulation setting for the operating pump)

The controller may be configured to determine values for at least two operating parameters using respective sensors. The controller may be configured to determine a valve setting for the valve by reference to a database containing valve settings correlated by the at least two operating parameters, or be evaluating a model of the heat engine.

The controller may be configured to determine a circulation setting for operating a pump of the heat engine based on the monitored operating parameter. The controller may be configured to determine the circulation setting for operating the pump by reference to a database or model.

The controller is configured to determine the overall volumetric expansion ratio over the expander, and to control the valve to maintain the overall volumetric expansion ratio within a predetermined optimal range.

The controller may be configured to determine the overall volumetric expansion ratio based partly on a volume flow rate out of the expander. The controller may be configured to monitor a rotary speed parameter of the expander. The controller may be configured to determine the volume flow rate out of the expander as a function of the rotary speed parameter of the expander.

The heat engine may be configured so that in use working fluid exiting the heat exchanger is single phase liquid at saturation temperature, or single-phase liquid at a sub-cool.

The controller may be configured to determine a dryness of the inlet working fluid downstream of the valve based on a thermodynamic property of the working fluid upstream of the valve, and a valve setting of the control valve. The controller may be configured to determine the volume flow rate into the expander based on the dryness of the inlet working fluid.

The controller may be configured to control a circulation setting of the pump, based on a temperature parameter relating to the temperature of the heat source or the temperature of working fluid at the heat exchanger, so that the saturation temperature of the working fluid at the heat exchanger is equal to or greater than the maximum temperature of the working fluid at the heat exchanger, such that in use working fluid exiting the heat exchanger is single phase liquid at saturation temperature or single-phase liquid at a sub-cool.

The expander may be a screw expander having a built-in volume ratio. The controller may be configured to maintain the overall volumetric expansion ratio within an optimal range corresponding to the built-in volume ratio. An optimal range for the overall volumetric expansion ratio may be the BIVR±5, or a closer range such as BIVR±2, BIVR±1 or BIVR±0.5.

According to a second aspect, there is disclosed a method of controlling a heat engine. The heat engine may comprise a heat exchanger to transfer heat from a heat source to a working fluid; a positive displacement expander configured to receive inlet working fluid from the heat exchanger and discharge expanded working fluid as a multiphase fluid so that there is an overall volumetric expansion ratio between the expanded working fluid and the inlet working fluid which is a function of an inlet dryness of the inlet working fluid. The method comprises: controlling a variable expansion valve disposed between the heat exchanger and the expander to introduce a variable pressure drop in the working fluid to vary the inlet dryness; wherein the overall volumetric expansion ratio is maintained by controlling the valve to compensate for variable heat transfer to or from the working fluid.

The heat engine may be in accordance with the first aspect.

The method may comprise monitoring an operating parameter relating to the overall volumetric expansion ratio; and controlling the valve based on the monitored operating parameter.

The method may comprise determining a valve setting for the valve by reference to a database or model based on the or each monitored operating parameter.

The method may comprise determining values for at least two operating parameters using respective sensors; and determining a valve setting for the valve by reference to a database containing valve settings correlated by the at least two operating parameters; or determining a valve setting for the valve by evaluating a model of the heat engine.

The method may comprise determining a circulation setting for operating a pump of the heat engine based on the monitored operating parameter.

The method may comprise determining the overall volumetric expansion ratio over the expander, and controlling the valve to maintain the overall volumetric expansion ratio within a predetermined optimal range.

The method may comprise monitoring a rotary speed parameter of the expander; determining the volume flow rate out of the expander as a function of the rotary speed parameter of the expander; and determining the overall volumetric expansion ratio partly based on the volume flow rate out of the expander.

The method may comprise controlling operation of the heat engine so that in use working fluid exiting the heat exchanger is single phase liquid at saturation temperature, or single-phase liquid at a sub-cool.

The method may comprise determining a dryness of the inlet working fluid downstream of the valve based on a thermodynamic property of the working fluid upstream of the valve, and a valve setting of the control valve; and determining the volume flow rate into the expander based on the dryness of the inlet working fluid.

The method may comprise monitoring a temperature parameter relating to the temperature of the heat source of the temperature of working fluid at the heat exchanger; and controlling a circulation setting of the pump, based on the temperature parameter so that the saturation temperature of the working fluid at the heat exchanger is equal to or greater than the maximum temperature of the working fluid at the heat exchanger; such that working fluid exiting the heat exchanger is single phase liquid at saturation temperature or single-phase liquid at a sub-cool.

The expander may be a screw expander having a built-in volume ratio, and the valve may be controlled to maintain the overall volumetric expansion ratio within an optimal range corresponding to the built-in volume ratio.

The invention may comprise any combination of the features and/or limitations referred to herein, except combinations of such features as are mutually exclusive.

The invention will now be described, by way of example, with reference to the accompanying drawings in which.

Figure 1:
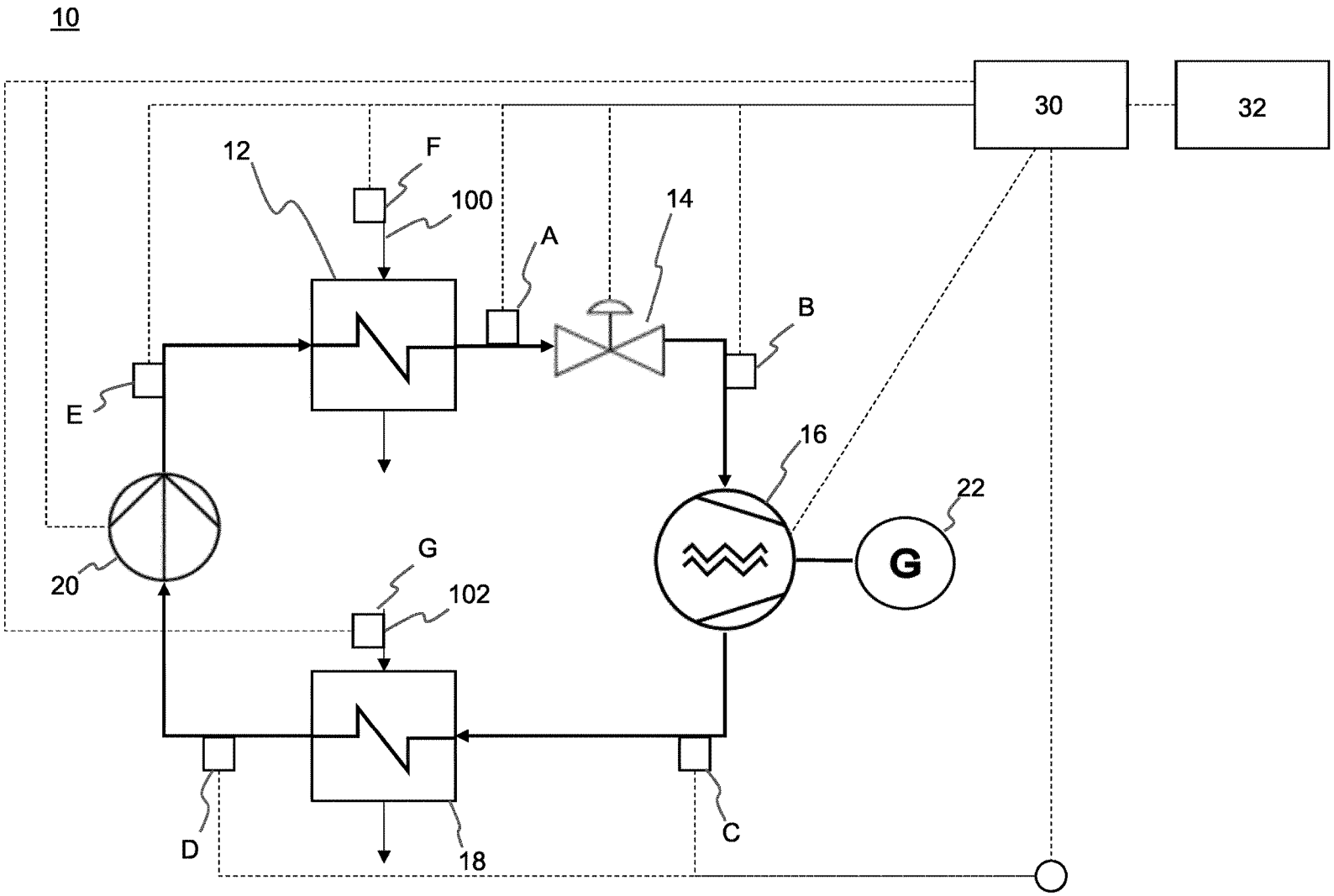
FIG. 1 shows an example heat engine.

FIG. 1 shows a heat engine 10 for converting thermal energy from a heat source to mechanical energy. In this example, the heat source 100 is a waste heat source, in particular a condensate discharge 100 from a steam system. The heat engine 10 comprises a working circuit including a primary heat exchanger 12, a variable expansion valve in the form of a control valve 14, a two-phase positive displacement expander 16, a condenser 18 and a pump 20 (which may be a compressor). In this example, the components are arranged in series around the circuit in the order described above, with respect to the direction of transport of a working fluid. The working fluid may be any suitable fluid, such as water or a refrigerant (e.g. R245fa). In this example, the two-phase expander 16 is a screw expander.

In this example, a generator 22 is coupled to the two-phase expander 16 for converting mechanical power from the expander 16 to electrical power.

The heat engine 10 further comprises a controller 30 configured to control the variable expansion valve 14, as will be described in detail below.

In this example, the controller 30 is also coupled to the pump 20 to control operation of the pump 20, and is coupled to a rotary sensor of the expander 16 to monitor a rotary property of the expander, as will be described below. However, in other examples, separate controllers may be provided for one or more of controlling the valve, controlling the pump 30, and monitoring a rotary property of the expander.

The heat engine 10 as shown in FIG. 1 is installed in an example plant so that a heat source side of the primary heat exchanger 12 is arranged to receive the waste heat source 100 so that in use heat is transferred from the waste heat source 100 to working fluid in a heat sink side of the primary heat exchanger.

Similarly, the condenser 18 is arranged to receive a cooling flow 102 in a heat sink side of the condenser, so that in use heat is transferred from working fluid in a heat source side of the condenser 18 to the cooling flow 102. For example, the cooling flow may be cool water.

In this example, sensors are disposed at monitoring locations around the working circuit for monitoring thermodynamic properties of the working fluid. The monitoring locations are referred to in the present disclosure by reference to the local condition of the working fluid. Sensors are provided in fluid lines between components of the heat engine 10 at:

- a heated location A (i.e. after heating of the working fluid at the primary heat exchanger 12) between the primary heat exchanger 12 and the control valve 14;
- a regulated location B (i.e. after regulation at the control valve) between the control valve 14 and the two-phase expander 16;
- an expanded location C (i.e. after expansion through the expander 16) between the two-phase expander 16 and the condenser 18;
- a condensed location D (i.e. after cooling of the working fluid at the condenser 18) between the condenser 18 and the pump 20; and
- a compressed location E (i.e. after compression by the pump 20) between the pump 20 and the primary heat exchanger 12.

In this example, temperature and pressure sensors are provided at each monitoring location. Flow meters configured to monitor mass flow rate, and phase sensors configured to monitor quality (i.e. dryness) of the working fluid are provided at the regulated location B between the control valve 14 and the expander 16, and at the expanded location C between the expander 16 and the condenser 18.

The controller 30 is coupled to each of the sensors at the monitoring locations A-E to receive output signals from the respective sensors.

In this example, sensors are also provided at monitoring locations F, G for monitoring properties of the waste heat source 100 and the cooling flow 102 respectively. There are temperature sensors, pressure sensors and mass flow rate sensors at each monitoring location F, G, which are also coupled to the controller 30.

A first set of three example unregulated thermal cycles around the working circuit will now be described with reference to FIG. 2, which shows a pressure-volume plot of working fluid around the working circuit for the three respective thermal cycles. In this first set of examples, the control valve 14 is fully open so that there is no regulation of the working fluid at the control valve—and as such these examples are referred to as "unregulated thermal cycles". The locations A-E described above are marked on the plot of FIG. 2 for cross-referencing with the locations shown on FIG. 1.

In these particular examples, the waste heat source temperature is 80°, 85° and 90° (centigrade) respectively, whereas the mass flow rate of the waste heat source 100 remains constant between the respective examples at 15°. Accordingly, the temperature difference between the heat source and the cooling flow varies between the respective examples. This temperature difference may be referred to as thermal power of the heat engine. As will be appreciated, the heat energy transferred from the waste heat source 100 to the heat engine 10 is a function of the temperature of the heat source. The mass flow rate of the working fluid around the working circuit may be varied to accommodate variations in heat transfer to or from the working fluid.

In these examples, the temperature of the working fluid exiting the primary heat exchanger 12 (i.e. at heated location A) is approximately 5° lower than the temperature of the waste heat source 100, whereas the temperature of the working fluid at the condenser 18 (i.e. at expanded location C and condensed location D) is approximately 5° higher than the temperature of the cooling flow 102.

In these examples, the heat engine 10 is configured and controlled to operate so that the pressure of the working fluid at the primary heat exchanger 12 and the condenser 16 is related to the temperature of the waste heat source 100 and the temperature of the cooling flow 102 respectively.

Since the working fluid exits the expander 16 and enters the condenser 18 as a two-phase fluid, it is inherently at saturation temperature. The pressure of the working fluid at the condenser is determined by the temperature of the working fluid through the condenser. This in turn is related to the temperature of the cooling flow 102. In these examples, the condenser 18 is configured and operated for isothermal heat transfer to condense the gas phase of the working fluid, and the temperature of the working fluid through the condenser is approximately 5° higher than the temperature of the cooling flow 102 (as mentioned above)—i.e. approximately 20°. A saturation temperature of 20° corresponds to a pressure of the working fluid of 1.32 bar (when the working fluid is R245fa).

Accordingly, there is no sub-cool at exit from the condenser, which would otherwise unnecessary cooling that would result in sub-optimal performance of the heat engine.

Further, heat exchangers (including condensers) may operate more efficiently when they are configured for either (i) isothermal heat transfer for phase change or (ii) heat transfer for temperature change of the working fluid—referred to as "specific heating" herein.

Accordingly, configuring and controlling the heat engine 10 so that only heat transfer for phase change occurs in the condenser (and not specific heating) may mean that a more efficient condenser optimised for that type of heat transfer may be installed.

In these example thermal cycles, the heat engine 10 is configured and controlled to operate so that the working fluid at the heated location A (i.e. as output from the primary heat exchanger 12) is partially vaporised with a low dryness fraction at a saturation temperature approximately 5° below the temperature of the hot waste source 100. In these particular example thermal cycles, the dryness fraction is 0.11.

For example, in the thermal cycle having a waste heat source temperature of 80°, the temperature of working fluid at the heated location A is approximately 75°. A pressure of 8.11 bar corresponds to a saturation temperature of 75°. The controller 30 operates the pump 20 so that the pressure at compressed location E is 8.11 bar, such that heating at the primary heat exchanger 12 may result in partial vaporisation to a dryness fraction of 0.11 at the saturation temperature of 75°.

In these particular examples, the pump 20 is a variable speed pump, such as a centrifugal pump, controlled to vary the pump speed (or power) to target a downstream pressure at heated location A as described above. In these examples, the pump is controlled by the controller 30, but in other examples it may have a separate pump controller.

In each example thermal cycle, the working fluid flows from the primary heat exchanger 12 to the two-phase expander 16, where it is expanded to convert thermal energy to mechanical energy in the expander 16. This in turn is converted to electrical energy by the generator 22.

Figure 2:
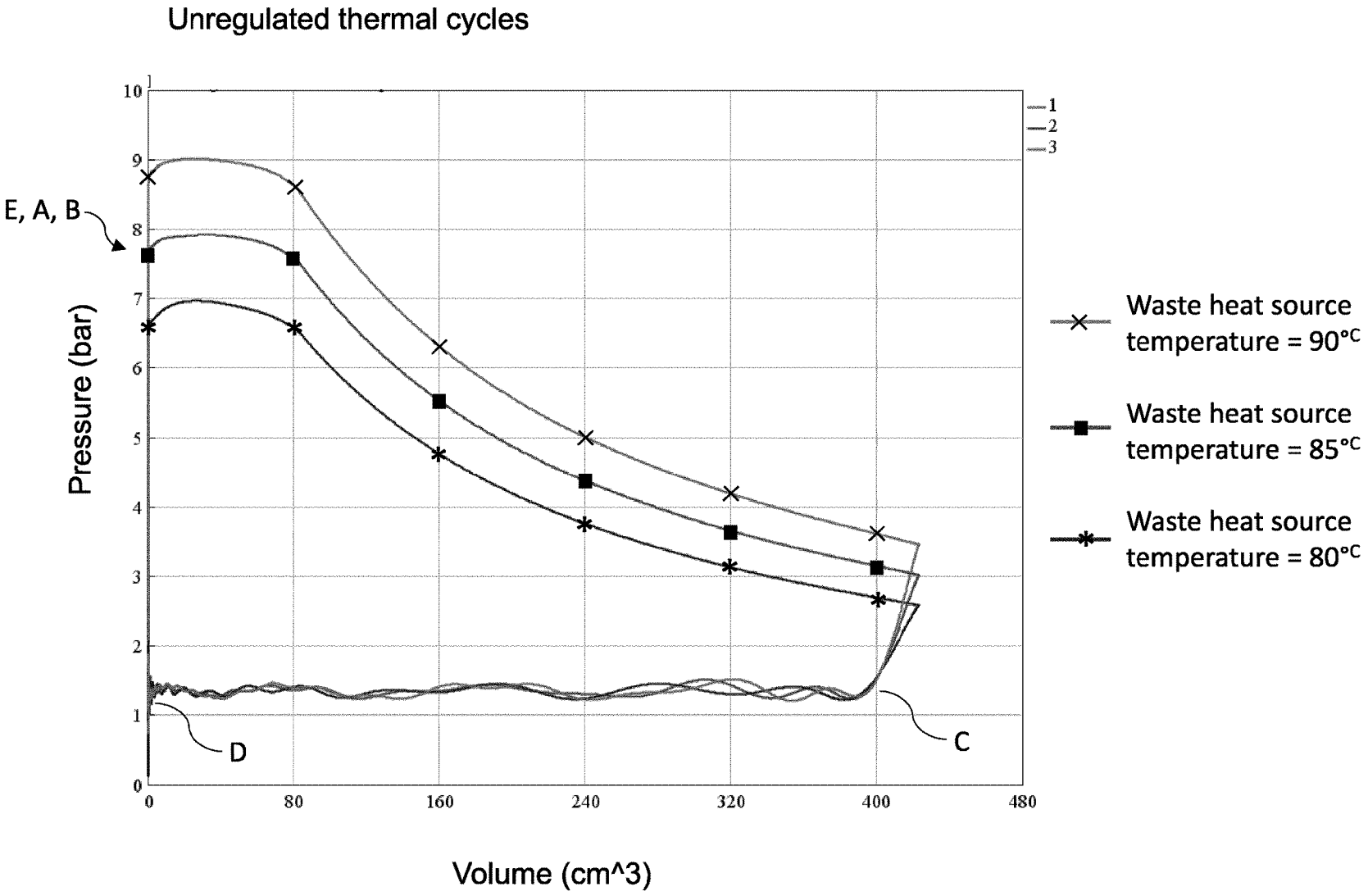
FIG. 2 shows a pressure-volume plot for unregulated thermal cycles through the heat engine of FIG. 1 in which there is under-expansion at the expander.

As shown in FIG. 2, the pressure reduces as the working fluid is continuously expanded in the two-phase expander 16 (i.e. in a smooth manner). However, in each of the examples, the fluid is under-expanded whilst it is within the expander, such that there is a discharge stage of discontinuous (i.e. abrupt) isenthalpic expansion upon discharge from the expander. Such discontinuous expansion may occur as a downstream chamber of the expander is placed in fluid communication with the fluid line between the expander 16 and the condenser 18.

In each of these examples, under-expansion occurs because the overall volumetric expansion ratio across the expander is greater than the BIVR of the machine. The overall volumetric expansion ratio is the ratio of volume of fluid before the expander to volume of the same fluid after the expander. This includes any (isenthalpic) expansion at the last chamber of the expander to reach the condenser pressure, which does not contribute to mechanical output of the expander and represents under-expansion.

The BIVR may correspond to the product of a first expansion stage of isenthalpic expansion, for example at an inlet to a first chamber of the expander, and a second expansion stage corresponding to the geometric volume ratio between first and last chambers of the expander. Usage of the term BIVR in the art in some cases refers to the pure geometric ratio only (i.e. the second expansion stage as described above), rather than this combination. In the present disclosure, the term BIVR is used to indicate the product of both stages, to the extent that a first stage of expansion is present. This may otherwise be referred to as the "apparent BIVR"—i.e. the BIVR that it is apparent between the first and last chambers of the expander.

The under-expansion represents losses with respect to an optimised expansion, as energy within the fluid is not fully converted into mechanical work by the expander 16.

In other examples, there may be over-expansion within the expander. For example, over-expansion may occur when the overall volumetric expansion ratio across the expander is lower than the BIVR. Over expansion occurs within the expander since it is constrained to expand the working fluid according to its geometric properties. In simplified terms, the flow through the expander can be considered to have two stages: an expansion stage in which the expander can be considered to be driven by expansion of the working fluid to extract mechanical energy, and a subsequent recompression stage in which the working fluid is effectively recompressed to the outlet pressure of the expander, which uses mechanical energy of the expander. The net result is that some of the mechanical energy extracted in the expansion stage is used to recompress the working fluid through the recompression stage, resulting in losses and sub-optimal efficiency.

When either under-expansion or over-expansion occurs, there is sub-optimal efficiency in the heat engine which results from a mis-match between the overall volumetric expansion ratio over the expander and the BIVR. In this particular example, the BIVR of the expander 16 is 5.

Following expansion in the expander 16 (i.e. at expanded location C), the working fluid is two-phase. The two-phase working fluid flows from the expander 16 to the condenser 18, where heat is transferred from the working fluid to the cooling flow 102 to cause the gas phase of the working fluid to condense.

The working fluid exits the condenser (i.e. at condensed location D) as 100% liquid at saturation temperature. The liquid working fluid flows from the condenser to the pump 20, where it is compressed as described above.

Given fixed thermal conditions—i.e. constant waste heat source and cooling flow conditions—it is possible to design a heat engine which operates so that the overall volumetric expansion ratio is matched with the BIVR of the expander for optimum efficiency of the expander. However, the applicant has found that variation in heat transfer to or from the working fluid causes deviation of the overall volumetric expansion ratio from the BIVR, resulting in sub-optimal performance.

The further disclosure below relates to methods of matching the overall volumetric expansion ratio to the BIVR despite variable heat transfer to and/or from the working fluid. This ensures that all expansion is done in the expander, without recompression—enabling maximum work to be extracted from the expanding working fluid.

The overall volumetric expansion ratio is difficult to determine by calculation because the expansion in the expander cannot be assumed to be isentropic, and depends on the performance and properties of the expander.

Accordingly, it is not possible to simply specify a fixed pressure ratio over the expander that would result in matching of the overall expansion ratio to the BIVR over a range of different inlet conditions.

The applicant considers there to be two principal methods of matching the overall expansion ratio to the BIVR. The first is a direct monitoring method to determine the overall expansion ratio and control a heat engine so that the overall expansion ratio matches the BIVR. The second is an indirect method of matching by monitoring the thermodynamic properties within the expander and controlling the heat engine so that these are matched with thermodynamic properties at the condenser.

In the direct method, the volume flow rate into the expander and the volume flow rate out of the expander are determined. The volume flow rate into the expander may be determined based on the mass flow rate and the quality (dryness) of the working fluid. The mass flow rate may be determined directly based on an output of a flow meter in the working circuit. Otherwise the mass flow rate may be indirectly, for example based on a predetermined relationship between mass flow rate and an operating parameter of the pump (e.g. rotary speed) and a thermodynamic property of the working fluid at the pump (e.g. pressure and temperature on entry to the pump).

The quality (dryness) of the working fluid into the expander may be determined directly, for example using a phase sensor upstream of the expander (e.g. at the regulated location B). Otherwise, it may be determined indirectly, such that a phase sensor is not required. Phase sensors may be expensive and inaccurate. For example, the heat engine may be operated so that the working fluid is 100% liquid at saturation temperature or a known sub-cool at exit from the primary heat exchanger (i.e. at heated location A). When a control valve is throttled between the primary heat exchanger and the expander, a change in quality (dryness) at the valve owing to isenthalpic expansion may be determined based on the pressure drop over the valve.

Upon exit from the expander the working fluid is two-phase at saturation temperature. The volume flow rate out of the expander may be determined based on the mass flow rate (e.g. as determined as above) and the quality (dryness) of the working fluid. The quality (dryness) may be determined using a phase sensor between the expander and the condenser (e.g. at expanded location C).

Otherwise, the volume flow rate out of the expander may be determined based on the rotary speed of the expander. In particular, as the expander is a positive displacement device, there is a predetermined relationship between rotary speed and volume flow rate out of the expander.

Knowing the volume flow rates in and out of the expander, the overall volumetric expansion ratio may be determined and compared with the BIVR. The controller may then vary the control valve to vary the thermodynamic properties of the working fluid into the expander in a feedback loop specifying the BIVR as a setpoint for the overall volumetric expansion ratio.

In the indirect method, the overall volumetric expansion ratio is matched to the BIVR indirectly by controlling the heat engine so that the thermodynamic properties in the last chamber of the expander match the thermodynamic properties of the working fluid at the condenser. This indicates that there is no over-expansion or under-expansion, such that the overall volumetric expansion ratio is matched to the BIVR of the expander.

For example, the pressure at the condenser may be determined using a pressure sensor at the expanded location C or condensed location D (for example), and the pressure in the last chamber of the expander may be determined using a pressure sensor installed in that chamber. The controller may determine the pressure difference between them, and vary the control valve in a feedback loop specifying nil as the setpoint for the pressure difference.

Further, since the working fluid exits the expander as a two-phase fluid (i.e. at saturation temperature), the pressure of the working fluid at exit is determined by the temperature of the working fluid through the condenser. This in turn is related to the temperature of the cooling flow. In the examples described herein, the temperature of the working fluid through the condenser is 5° higher than the temperature of the cooling flow.

Therefore, the controller may otherwise determine a temperature difference between the temperature at the condenser (for example as determined using a temperature sensor at the expanded location C or condensed location D) and the temperature in the last chamber of the expander using a temperature sensor there. The controller may vary the control valve in a feedback loop specifying nil as the setpoint for the temperature difference.

However, it may be difficult to install a pressure sensor and a temperature sensor in the last chamber of the expander. Accordingly, it may be advantageous to determine the volume flow rate out of the expander based on the rotary speed parameter as described above.

A further set of three example regulated thermal cycles will now be described with reference to FIG. 3, in which examples the controller 30 operates to maintain the overall volumetric expansion ratio within an optimal range by controlling the control valve 14 to compensate for variable heat transfer to or from the working fluid.

An optimal range for the overall volumetric expansion ratio may be the BIVR±5, or a closer range such as BIVR±2, BIVR±1 or BIVR±0.5. Variable heat transfer to or from the working fluid may occur owing to changes in the waste heat source flow 100 or the cooling flow 102, for example a change in temperature or mass flow rate.

The controller 30 operates the control valve to introduce a variable pressure drop across the control valve 14 between the primary heat exchanger 12 and the expander 16 (i.e. between the heated location A and the regulated location B).

Figure 3:
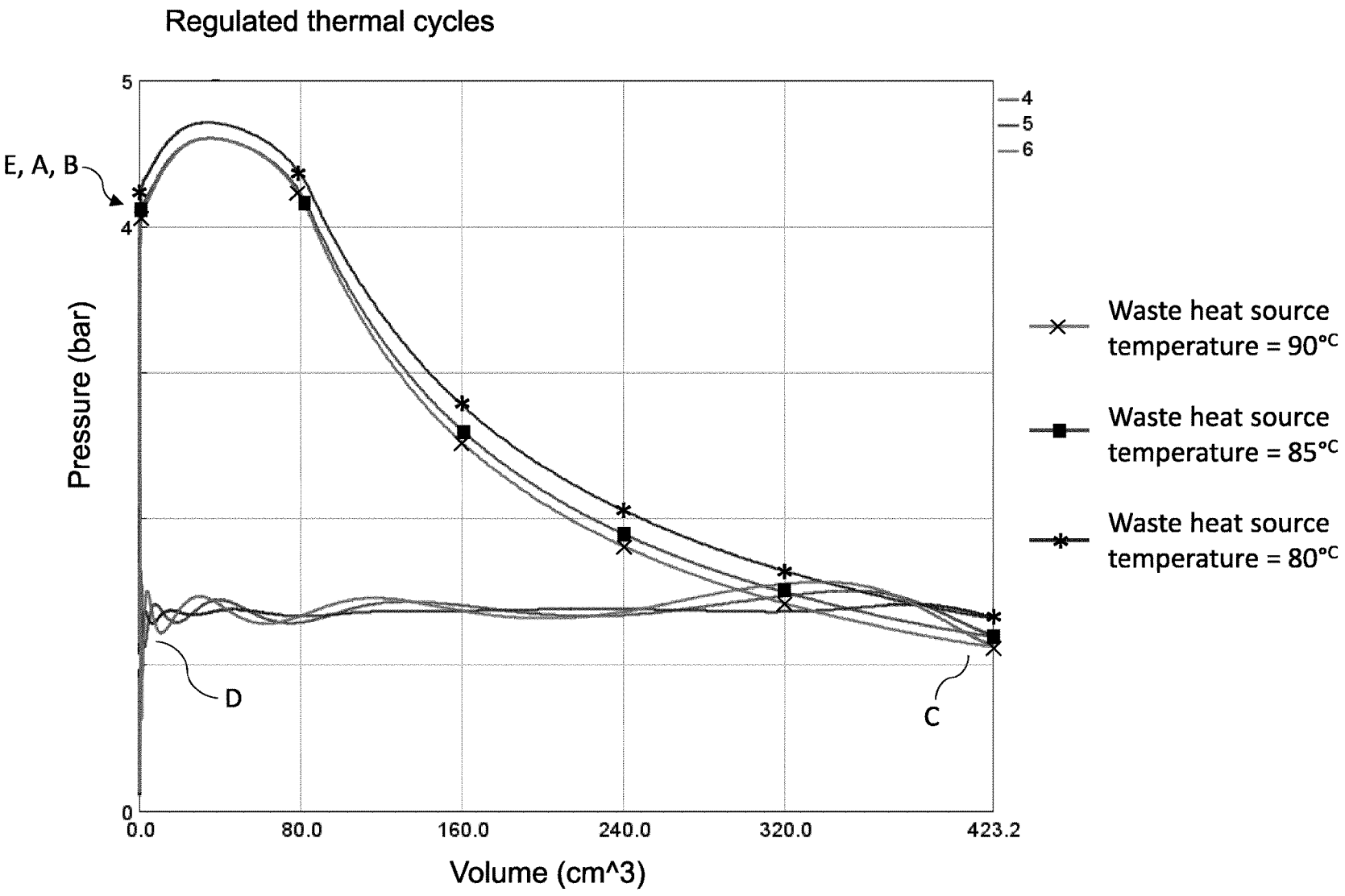
FIG. 3 shows a pressure-volume plot for a regulated thermal cycle through the heat engine of FIG. 1 in which there is controlled isenthalpic expansion upstream of the expander.

FIG. 3 shows pressure-volume plots of three example regulated thermal cycles corresponding to waste heat source temperatures of 80°, 85° and 90° (centigrade) respectively, and a cooling flow 102 temperature of 15° (as in the example unregulated thermal cycles described above). As with FIG. 2, the locations A-E around the thermal cycle are shown in the plot for cross-referencing.

The pump 20 is operated as described above with respect to the unregulated thermal cycles, such that the pressure of the working fluid at the heated location A and the expanded location C is the same between the corresponding unregulated and regulated thermal cycles (i.e. between the 85° unregulated thermal cycle and the 85° regulated thermal cycle, and so forth), and thereby the heat transfer to and from the working fluid, and the temperature of the working fluid at those locations corresponds accordingly. For example, in both the regulated and unregulated 85° example thermal cycles, the quality (i.e. dryness) of the working fluid at the heated location A is 0.11 and the pressure is 8.11 bar.

However, in the regulated thermal cycles, the controller 30 controls the valve 14 to throttle the flow of working fluid between the primary heat exchanger 12 and the two-phase expander 16 to introduce a pressure drop (which is considered to be isenthalpic).

By way of example and as shown in FIG. 3, the pressure of the working fluid in the 85° regulated thermal cycle prior to expansion in the expander is lower than that in the 85° unregulated thermal cycle.

In the example 85° regulated thermal cycle, the control valve 14 is throttled so that it is 32% open, thereby introducing a pressure drop from 8.11 bar to 5.11 bar which results in a quality (i.e. dryness) of the working fluid at regulated location B for entry to the two-phase expander of approximately 0.26. The quality (dryness) increases because the pressure drop lowers the saturation temperature, and thereby causes phase change (i.e. flashing, vaporisation) of the working fluid.

As the dryness is increased, the volumetric flow rate into the expander 16 is consequently increased. Coupled with the reduction in pressure and associated variable performance of the expander 16, this results in a reduction in the overall volumetric expansion ratio (relative the corresponding unregulated thermal cycle) to match the BIVR of the expander.

Between the example regulated cycles, the controller controls the control valve 14 to maintain the overall volumetric expansion ratio over the expander 16 to compensate for variable heat transfer to the working fluid, as set out below. In other examples, the overall volumetric expansion ratio may be maintained to compensate for variable heat transfer from the working fluid.

By way of comparative example, in the 90° regulated thermal cycle there is more heat transfer to the working fluid than in the 85° regulated thermal cycle at the primary heat exchanger 12. Accordingly, in the 90° regulated thermal cycle the pressure of the working fluid at the heated location A is higher (at 9.17 bar) than the corresponding pressure in the 85° regulated thermal cycle (8.11 bar) to have a correspondingly higher saturation temperature, in order that the same quality (i.e. dryness) of 0.11 may be maintained at the heated location A.

In the 90° regulated thermal cycle, the controller controls the control valve 14 so that it is throttled to 29% open, thereby introducing a pressure drop from 9.17 bar to 5.17 bar that results in a quality (i.e. dryness) downstream of the control valve 14 at the regulated location B of 0.3 (compared with 32% throttling in the 85° thermal cycle for a pressure drop to 5.11 bar and a quality (i.e. dryness) at the regulated location B of 0.26).

By way of further comparative example, in the 80° regulated thermal cycle the controller controls the control valve 14 so it is throttled to 36% open, resulting in a dryness downstream of the valve of 0.21.

The example regulated thermal cycles are described above without reference to the particular operating parameters that are monitored by the controller in order to vary the pressure drop introduced by the control valve.

Such examples of monitoring and control will now be described, by way of example, with respect to the heat engine 10 of FIG. 1.

As described above, in the example heat engine 10 of FIG. 1 there are sensors for monitoring properties of the working fluid at multiple locations around the working circuit, together with sensors for monitoring properties of the waste heat source 100 and the cooling flow.

However, the controller 30 may be configured to control the valve by monitoring a limited number of parameters derived from respective sensors.

The sensor arrangement in the example heat engine 10 of FIG. 1 therefore represents a significant amount of redundancy. This sensor arrangement of the heat engine 10 is disclosed by way of example to indicate where sensors may be provided. In practical implementations, fewer sensors would be provided.

The controller 30 may be configured to control the valve 14 to maintain the overall volumetric expansion ratio in many different ways. The further description below describes a first direct monitoring and control method in which the overall volumetric expansion ratio is directly determined for use in a control procedure, and a second indirect monitoring and control method in which an operating parameter is determined and the valve is controlled based on a predetermined relationship with the operating parameter.

In the first example method, the controller 30 is configured to determine an overall volumetric expansion ratio parameter which is a function of the overall volumetric expansion ratio across the expander 16. The controller 30 determines an input volume flow rate parameter based on the outputs of the phase sensor at regulated location B, the pressure sensor at regulated location B and the mass flow meter at regulated location B, which is a function of the volume flow rate into the expander. The controller 30 determines an output volume flow rate parameter based on the outputs of the phase sensor at expanded location C, the pressure sensor at expanded location C and the mass flow meter at regulated location B (as the mass flow rate is constant around the working circuit), which is a function of the volume flow rate out of the expander.

In this example, the input and output volume flow rate parameters are measures of the input and output volume flow rates, such that the overall volumetric expansion ratio can directly be determined by their combination. In other examples, the input and output volume flow rate parameter need not be the actual volume flow rates, but may be parameters that are a function of the respective volume flow rates—for example proportional to the volume flow rate or otherwise related to it such that their combination can provide an overall volumetric expansion ratio parameter which is a function of the overall volumetric expansion ratio across the expander.

The controller 30 varies the valve setting of the control valve 14 in a control loop which targets a setpoint for the overall volumetric expansion ratio parameter corresponding to the BIVR of the expander.

In variations of this first example, the controller may determine the volume flow rate parameters without using phase sensors at one or both of the regulated location B and the expanded location C. For example, as described above the volume flow rate out of the expander may be determined based on a rotary speed parameter and a pressure and temperature of the working fluid at the expanded location C. Further, when the heat engine is configured and controlled so that the working fluid out of the primary heat exchanger is 100% liquid, the volume flow rate into the expander may be determined based on a predetermined relationship between a parameter related to valve setting of the control valve and downstream phase proportions. The parameter may be the pressure drop (as measured by pressure sensors) or the valve setting itself, for example.

Figure 4:
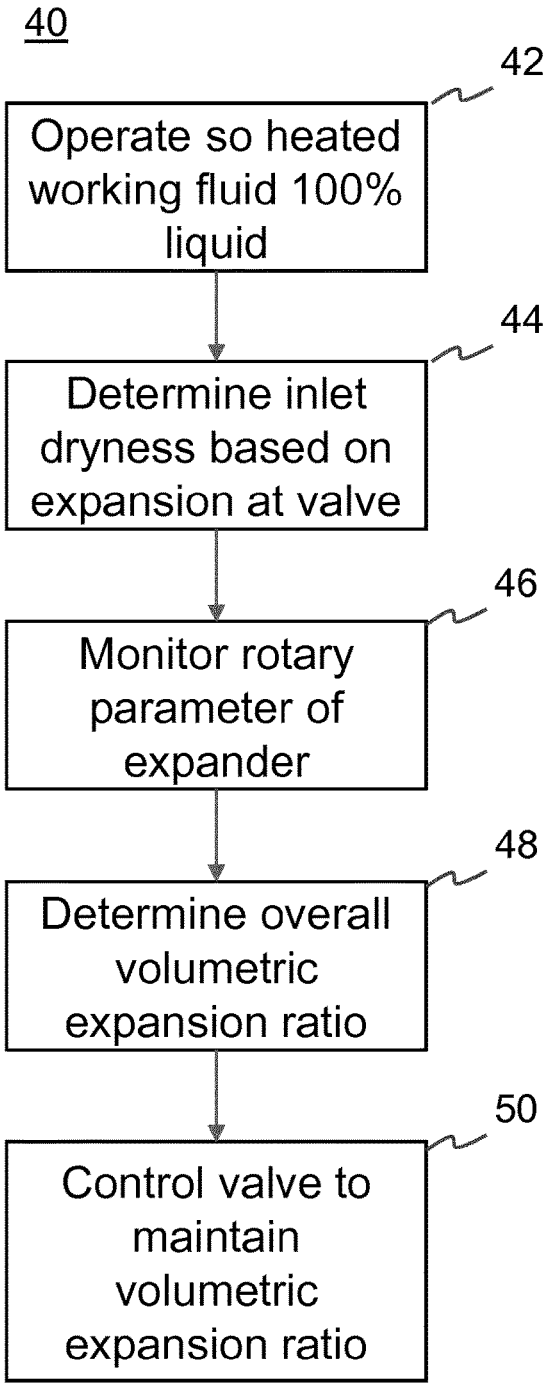
FIGS. 4 and 5 are flowcharts are methods of monitoring and control of a valve to directly and indirectly maintain volumetric expansion ratio respectively.

FIG. 4 shows a flowchart of an example method 40 described above. At block 42, the heat engine is operated so that the working fluid out of the primary heat exchanger is 100% liquid. At block 44, the inlet dryness of the inlet working fluid is determined based on expansion at the valve (i.e. based on a thermodynamic property of the working fluid upstream of the valve, and based on a valve setting of the valve). At block 46, a rotary parameter of the expander is monitored. At block 48, the overall volumetric expansion ratio is determined as described above, including by determining the volume flow rate into the expander and by determining the volume flow rate out of the expander as described above. At block 50, the valve is controlled to maintain the volumetric expansion ratio in an optimum range corresponding to the BIVR of the expander, based on the overall volumetric expansion ratio determined in block 48.

Accordingly, in this first example described above (and variations indicated above), the controller 30 directly monitors the quantity that is to be maintained (i.e. overall volumetric expansion ratio) and utilises this in a feedback loop to set the valve setting of the control valve 14.

A database of valve settings corresponding to matching between the BIVR and the overall volumetric expansion ratio, correlated by operating configuration of the heat engine, may be generated. Such a database may be generated empirically by operating a heat engine 10 at a plurality of different operating configurations of the heat engine 10 and determining the appropriate valve setting as described above. Otherwise, such a database may be generated using a representative thermal model of the heat engine in which expander performance is simulated (for example, using thermodynamic simulation such as computational fluid dynamics (CFD)), and appropriate valve settings are determined for respective operating configurations as described above, but based on the simulation rather than physical operation.

An operating configuration of the heat engine 10 is a set of operating parameters that determine the thermal cycle. Operating parameters may include external operating parameters relating to thermal conditions outside of the heat engine, which affect the operation of the thermal cycle in the heat engine. External operating parameters may include:

- temperature of the heat source;
- mass flow rate of the heat source
- temperature of the cooling flow;
- mass flow rate of the cooling flow;
- heat source composition (e.g. water or another material);

cooling flow composition (e.g. water or another material).

Operating parameters may include internal operating parameters which affect the operation of the thermal cycle in the heat engine. Internal operating parameters may include:

composition of the working fluid;

a pump control parameter determining how the pump controls the pressure at the primary heat exchanger to affect the phase compositions of the working fluid at exit from the primary heat exchanger (e.g. 100% liquid at saturation, 100% liquid at a predetermined sub-cool, or two-phase fluid at a specified or unspecified dryness).

Operating parameters may also include passive operating parameters which are not controlled to vary directly, but vary in response to other factors and are indicative of operation of the thermal cycle. Passive operating parameters may include:

pressure, temperature, phase composition at any monitored location in the working circuit;

mass flow rate of the working fluid;

a circulation setting of the pump (as described below);

a rotary speed parameter of the expander.

As will be appreciated, there may be many different operating configurations relating to different permutations of the above operating parameters. In practice, a limited number of operating parameters may be considered to vary for a particular type of heat engine, such that valve settings may be determined (either empirically or by simulation) and populate a database of reasonable size. For example, in certain installations it may be expected that the cooling flow will vary only in temperature and not in mass flow rate, and over a limited range.

Otherwise, a model may be generated, for example based on empirical or simulated data generated as described above, by which appropriate valve settings may be determined as a function of many operating parameters. The model may comprise simplified relationships between the valve setting and the operating parameters, to provide an estimate for a valve setting corresponding to an optimal range for the overall volumetric expansion ratio (e.g. BIVR±5, or a closer range such as BIVR±2, BIVR±1 or BIVR±0.5).

In the same way, the database or model may include circulation settings derived controlling the pump. For example, and as described above, the pressure of the working fluid exiting the pump (i.e. at compressed location E) may be varied in accordance with variation of the heat transfer from the heat source into the working fluid. For example, a circulation setting may be a peak pressure at compressed location E, and the pump may be operated based on the target pressure with a feedback loop from a pressure sensor at compressed location E or heated location A. In other examples, the circulation setting may be a rotational speed of the pump 20 that is determined, either empirically or using the thermal model, to result in a suitable pressurisation. In yet further examples, the circulation setting may be a target mass flow rate, and the pump 20 may be operated based on the target mass flow rate with a feedback loop from a mass flow rate meter at any position within the working circuit.

Such a database or model as described above may be generated using a baseline configuration of a heat engine incorporating sufficient sensors to collect the input data for the database, or using a baseline simulation of such a heat engine. The term "baseline" is used to distinguish between a first heat engine (whether physical or simulated), and other heat engines having a similar configuration which may be operated by reference to the database or model using an indirect monitoring and control method as will now be described.

In this second example, the volumetric expansion ratio is not directly determined, but is maintained by monitoring one or more operating parameters of the heat engine, and controlling the valve to compensate for corresponding heat transfer variations to maintain the overall volumetric expansion ratio by reference to a database or model as described above.

As explained above, there may be many operating parameters which affect the overall volumetric expansion ratio. Such operating parameters may include, for example, external operating parameters including the mass flow rate and temperature of each of the heat source and the cooling flow.

However, depending on the configuration of the heat engine, a number of those factors may be kept constant such that it is not necessary to monitor them. For example, properties of the cooling flow may be known, or otherwise independently controlled to flow at a set temperature and flow rate.

Accordingly, at one extreme, a heat engine may be installed and configured so there can be no variation in any of the operating parameters. In such a heat engine, it is not necessary to monitor and control any operating parameters to vary the control valve to compensate for variable heat transfer to or from the working fluid, as there is no scope for such variation.

In some examples, a heat engine installation (i.e. a heat engine as installed in a plant) may be configured so that only one operating parameter that affects the overall volumetric expansion ratio is permitted to vary, for example the temperature of the cooling flow 102. Such a heat engine may be described as having one degree of freedom, since the appropriate valve setting to maintain the volumetric expansion ratio is only variable based on the one operating parameter. Accordingly, an indirect monitoring and control method for such a heat engine may look up the valve setting based on the respective operating parameter using a look-up table containing valve settings correlated by that parameter.

For example, the operating parameter may be the temperature of the cooling flow itself (which is an external operating parameter as explained above). Otherwise, the operating parameter may be a passive operating parameter related to the temperature of the cooling flow, for example the temperature of the working fluid at the condenser, or the pressure of the working fluid at the condenser (e.g. at the expanded location C or the condensed location D).

The same principle extends to heat engine installations in which more than one operating parameter that affects the overall volumetric expansion ratio is permitted to vary. For example, a heat engine installation where two such operating parameters are permitted to vary may be described to as having two degrees of freedom.

By way of example, an indirect monitoring and control method will be described below, with reference to the heat engine 10 of FIG. 1, in which the single operating parameter which is permitted to vary is the temperature of the cooling flow 102.

In this example, an internal operating parameter of the heat engine differs from the examples described above in that the pump is controlled so that the pressure at the primary heat exchanger so that the working fluid at exit from the primary heat exchanger is 100% liquid at a sub-cool of 2°. In this example, the temperature of the waste heat source 100 is fixed at 85°, and the temperature of the working fluid at exit of the primary heat exchanger 4° lower at 81°. A sub-cool of 2° therefore corresponds to a saturation temperature of 83°, which corresponds to a pressure in the primary heat exchanger 12 of 8.09 bar. The pump 20 is therefore controlled to target a downstream pressure at compressed location E (or heated location A) of 8.09 bar.

In this example, the controller 30 monitors a cooling flow temperature parameter output from a temperature sensor at monitored location G (i.e. in the cooling flow 102) relating to the temperature of the cooling flow. In this example, the cooling flow temperature parameter is the monitored temperature. However, as indicated above, in other examples the cooling flow temperature parameter may not be the actual temperature of the cooling flow, but may be a function of the temperature. For example, it may be an uncalibrated output of a temperature sensor (e.g. in units of mV) which is proportional to the temperature.

The controller 30 monitors the cooling flow temperature parameter periodically, for example at 10 second intervals. By way of example, at time interval i1 the temperature of the cooling flow is 15°. In this example, this corresponds to an (unmonitored) temperature of the working fluid at the condenser of approximately 20° and a pressure of 1.18 bar. The controller 30 refers to the database of valve settings correlated by the cooling flow temperature parameter to determine a suitable valve setting based on the cooling flow temperature parameter, which returns a valve setting corresponding to a pressure drop of 2.9 bar from 8.09 bar to 5.19 bar at the control valve (in some examples, the valve setting may be a throttling amount or a target pressure drop).

The controller 30 controls throttling of the control valve 14 to implement the pressure drop, by monitoring outputs from the pressure sensor at regulated location B.

The controller 30 continues to monitor the cooling flow temperature parameter at 10 second intervals. In this example, after 4 further intervals (i.e. at interval i5) the controller determines that the cooling flow temperature parameter has reduced by from 15° to 11°. Owing to the variation, the controller 30 refers to the database and obtains an updated valve setting correlated to the new cooling flow temperature parameter which corresponds to a pressure drop of 3.5 bar from 8.09 bar to 4.6 bar.

In some examples, the controller 30 may only refer to the database or model for an updated valve setting when it determines a variation in the monitored operating parameter relative a previous reference to the database which is above a threshold variation.

In this example, the database is stored locally on memory (a non-transitory storage medium) in the controller 30. However, in other examples, the database may be stored remotely, and may be accessed via a wired or wireless connection. The database may be accessed over a remote connection such as an internet connection.

Whilst the above description relates to variation of a single operating parameter (i.e. one degree of freedom), it will be appreciated that the same principles apply to more complex examples having multiple degrees of freedom.

In the above example, the pump is controlled based on a target pressure corresponding to a 2° sub-cool at exit of the primary heat exchanger. Since the temperature of the waste heat source 100 does not change in this example, the controller does not look up a circulation setting for the pump based on any monitored parameter. However, in other examples, the controller may look up a circulation parameter for varying control of the pump based on the monitored operating parameters.

Figure 5:
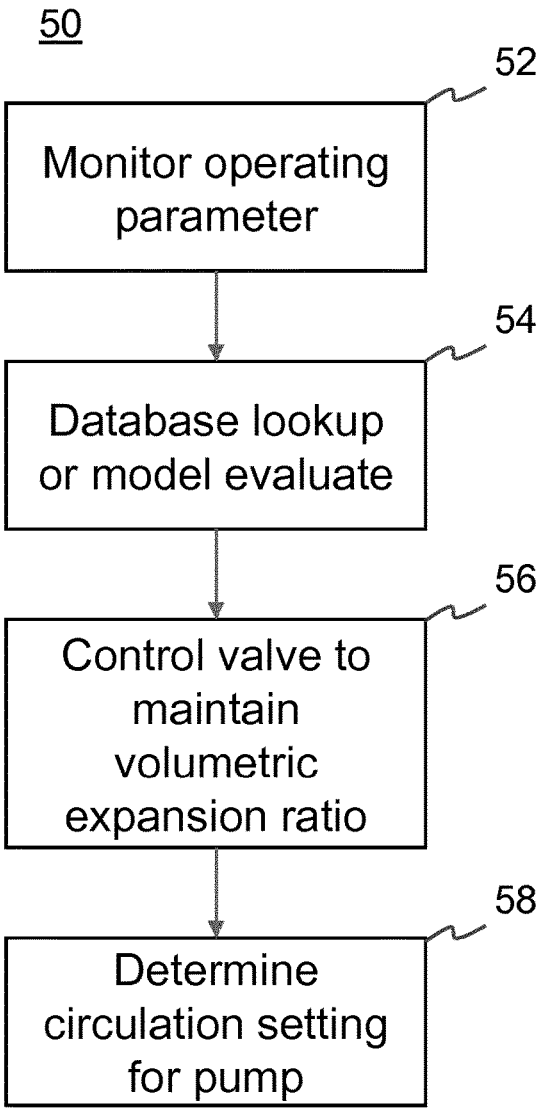

FIG. 5 is a flowchart of an example method 50 of indirect monitoring and control as described above. In block 52, an operating parameter is monitored, such as the temperature of the cooling gas flow 102. In block 54, a database is referred to, or a model evaluated, to determine at least a valve setting for the control valve. In block 56, the control valve is controlled based on the valve setting to maintain the volumetric expansion ratio to compensate for variable heat transfer to or from the working fluid. In block 58, optionally a circulation setting for the pump is determined, for example by reference to the same or a different database or model.

In the examples described above, the two-phase expander is a screw expander. However, the disclosure applies to other types of positive displacement expander.

All example temperature values discussed herein are in degrees centigrade.

The invention claimed is:

1. A heat engine comprising:

a heat exchanger to transfer heat from a heat source to a working fluid;

a positive displacement expander configured to receive inlet working fluid from the heat exchanger and discharge expanded working fluid as a multiphase fluid so that there is an overall volumetric expansion ratio between the expanded working fluid and the inlet working fluid which is a function of an inlet dryness of the inlet working fluid;

a variable expansion valve disposed between the heat exchanger and the expander, the valve being configured to introduce a variable pressure drop in the working fluid to vary the inlet dryness;

a controller configured to maintain the overall volumetric expansion ratio by controlling the valve to compensate for variable heat transfer to or from the working fluid.

2. A heat engine according to claim 1, wherein the controller is configured to monitor an operating parameter relating to the overall volumetric expansion ratio; and wherein the controller is configured to control the valve based on the operating parameter.

3. A heat engine according to claim 2, wherein the operating parameter is selected from the group consisting of:

a thermodynamic property of the heat source;

a flow rate of the heat source;

a thermodynamic property of a cooling flow to which heat is transferred from the working fluid in the heat engine;

a flow rate of the cooling flow;

a thermodynamic property of the working fluid at a monitor location in the heat engine, such as a temperature, pressure or phase composition of the working fluid;

a mass flow rate of the working fluid;

a circulation setting of a pump of the heat engine;

the inlet dryness of the working fluid to the expander;

a rotary speed parameter relating to a rotary speed of the expander.

4. A heat engine according to claim 2, wherein the controller is configured to determine a valve setting for the valve by reference to a database or model based on the operating parameter.

5. A heat engine according to claim 4, wherein the controller is configured to determine values for at least two operating parameters using respective sensors; and wherein the controller is configured to determine a valve setting for the valve by reference to a database containing valve settings correlated by the at least two operating parameters, or be evaluating a model of the heat engine.

6. A heat engine according to claim 2, wherein the controller is configured to determine a circulation setting for operating a pump of the heat engine based on the operating parameter.

7. A heat engine according to claim 2, wherein the controller is configured to determine the overall volumetric expansion ratio over the expander, and to control the valve to maintain the overall volumetric expansion ratio within a predetermined optimal range.

8. A heat engine according to claim 7, wherein the controller is configured to determine the overall volumetric expansion ratio based partly on a volume flow rate out of the expander; and wherein the controller is configured to monitor a rotary speed parameter of the expander; and wherein the controller is configured to determine the volume flow rate out of the expander as a function of the rotary speed parameter of the expander.

9. A heat engine according to claim 7, configured so that in use working fluid exiting the heat exchanger is single phase liquid at a saturation temperature, or single-phase liquid at a sub-cool.

10. A heat engine according to claim 7, wherein the controller is configured to determine a dryness of the inlet working fluid downstream of the valve based on a thermodynamic property of the working fluid upstream of the valve, and a valve setting of the valve; and wherein the controller is configured to determine a volume flow rate into the expander based on the dryness of the inlet working fluid.

11. A heat engine according to claim 1, wherein the controller is configured to control a circulation setting of a pump of the heat engine, based on a temperature parameter relating to a temperature of the heat source or a temperature of working fluid at the heat exchanger, so that a saturation temperature of the working fluid at the heat exchanger is equal to or greater than a maximum temperature of the working fluid at the heat exchanger;

such that in use working fluid exiting the heat exchanger is single phase liquid at the saturation temperature or single-phase liquid at a sub-cool.

12. A method of controlling a heat engine, the heat engine comprising a heat exchanger to transfer heat from a heat source to a working fluid; a positive displacement expander configured to receive inlet working fluid from the heat exchanger and discharge expanded working fluid as a multiphase fluid so that there is an overall volumetric expansion ratio between the expanded working fluid and the inlet working fluid which is a function of an inlet dryness of the inlet working fluid;

the method comprising:

controlling a variable expansion valve disposed between the heat exchanger and the expander to introduce a variable pressure drop in the working fluid to vary the inlet dryness;

wherein the overall volumetric expansion ratio is maintained by controlling the valve to compensate for variable heat transfer to or from the working fluid.

13. A method according to claim 12, comprising monitoring an operating parameter relating to the overall volumetric expansion ratio; and controlling the valve based on the operating parameter.

14. A method according to claim 13, wherein the operating parameter is selected from the group consisting of:

a thermodynamic property of the heat source;

a flow rate of the heat source;

a thermodynamic property of a cooling flow to which heat is transferred from the working fluid in the heat engine;

a flow rate of the cooling flow;

a thermodynamic property of the working fluid at a monitor location in the heat engine, such as a temperature, pressure or phase composition of the working fluid;

a mass flow rate of the working fluid;

a circulation setting of a pump of the heat engine;

the inlet dryness of the working fluid to the expander;

a rotary speed parameter relating to a rotary speed of the expander.

15. A method according to claim 13, comprising determining a valve setting for the valve by reference to a database or model based on the operating parameter.

16. A method according to claim 14, comprising determining a circulation setting for operating a pump of the heat engine based on the operating parameter.

17. A method according to claim 14, comprising determining the overall volumetric expansion ratio over the expander, and controlling the valve to maintain the overall volumetric expansion ratio within a predetermined optimal range.

18. A method according to claim 17, comprising controlling operation of the heat engine so that in use working fluid exiting the heat exchanger is single phase liquid at saturation temperature, or single-phase liquid at a sub-cool.

19. A method according to claim 17, comprising determining a dryness of the inlet working fluid downstream of the valve based on a thermodynamic property of the working fluid upstream of the valve, and a valve setting of the valve; and determining a volume flow rate into the expander based on the dryness of the inlet working fluid.

20. A method according to claim 12, comprising monitoring a temperature parameter relating to a temperature of the heat source or a temperature of working fluid at the heat exchanger; and controlling a circulation setting of a pump of the heat engine, based on the temperature parameter so that a saturation temperature of the working fluid at the heat exchanger is equal to or greater than a maximum temperature of the working fluid at the heat exchanger;

such that working fluid exiting the heat exchanger is single phase liquid at the saturation temperature or single-phase liquid at a sub-cool.

* * * * *